US006044834A

United States Patent [19]

Zappetti

[11] Patent Number: 6,044,834

[45] Date of Patent: Apr. 4, 2000

[54] STOVE TOP PROTECTIVE COVER

[76] Inventor: Nicholas Zappetti, 9 Arlene St., Staten Island, N.Y. 10314

[21] Appl. No.: 09/248,710

[22] Filed: Feb. 11, 1999

[51] Int. Cl.[7] ..... F24C 3/00

[52] U.S. Cl. ..... 126/39 M; 126/214 D

[58] Field of Search ..... 126/39 M, 214 R, 126/214 D

[56] References Cited

U.S. PATENT DOCUMENTS 3,490,123 1/1970 Clark ..... 126/39 M 5,353,781 10/1994 Calvillo ..... 126/39 M

FOREIGN PATENT DOCUMENTS 2626965 8/1989 France ..... 126/39 M

*Primary Examiner*—Carroll Dority

[57] ABSTRACT

A stove top protective cover for protecting a stove top from stains and spills when cooking on the stove top. The stove top protective cover includes a flexible panel with a plurality of spaced apart sets of concentric separation lines. The panel is separable along each of the separation lines to form corresponding holes through the panel.

17 Claims, 2 Drawing Sheets

STOVE TOP PROTECTIVE COVER

BACKGROUND OF THE INVENTION

1. Field of the Invention

The present invention relates to stove top protective covers and more particularly pertains to a new stove top protective cover for protecting a stove top from stains and spills when cooking on the stove top.

2. Description of the Prior Art

The use of stove top protective covers is known in the prior art. More specifically, stove top protective covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,045,606 by Kalkowski; U.S. Pat. No. 3,490,123 by Clark; U.S. Pat. No. 5,115,797 by Hurner; U.S. Pat. No. 5,331,945 by Somerton; U.S. Pat. No. 5,353,781 by Calvillo; and U.S. Pat. No. Des. 348,800 by Doty et al.

While these devices fulfill their respective, particular objectives and requirements, the aforementioned patents do not disclose a new stove top protective cover. The inventive device includes a flexible panel with a plurality of spaced apart sets of concentric separation lines. The panel is separable along each of the separation lines to form corresponding holes through the panel.

In these respects, the stove top protective cover according to the present invention substantially departs from the conventional concepts and designs of the prior art, and in so doing provides an apparatus primarily developed for the purpose of protecting a stove top from stains and spills when cooking on the stove top.

SUMMARY OF THE INVENTION

In view of the foregoing disadvantages inherent in the known types of stove top protective covers now present in the prior art, the present invention provides a new stove top protective cover construction wherein the same can be utilized for protecting a stove top from stains and spills when cooking on the stove top.

The general purpose of the present invention, which will be described subsequently in greater detail, is to provide a new stove top protective cover apparatus and method which has many of the advantages of the stove top protective covers mentioned heretofore and many novel features that result in a new stove top protective cover which is not anticipated, rendered obvious, suggested, or even implied by any of the prior art stove top protective covers, either alone or in any combination thereof.

To attain this, the present invention generally comprises a flexible panel with a plurality of spaced apart sets of concentric separation lines. The panel is separable along each of the separation lines to form corresponding holes through the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stove top protective cover apparatus and method which has many of the advantages of the stove top protective covers mentioned heretofore and many novel features that result in a new stove top protective cover which is not anticipated, rendered obvious, suggested, or even implied by any of the prior art stove top protective covers, either alone or in any combination thereof.

It is another object of the present invention to provide a new stove top protective cover which may be easily and efficiently manufactured and marketed.

It is a further object of the present invention to provide a new stove top protective cover which is of a durable and reliable construction.

An even further object of the present invention is to provide a new stove top protective cover which is susceptible of a low cost of manufacture with regard to both materials and labor, and which accordingly is then susceptible of low prices of sale to the consuming public, thereby making such stove top protective cover economically available to the buying public.

Still yet another object of the present invention is to provide a new stove top protective cover which provides in the apparatuses and methods of the prior art some of the advantages thereof, while simultaneously overcoming some of the disadvantages normally associated therewith.

Still another object of the present invention is to provide a new stove top protective cover for protecting a stove top from stains and spills when cooking on the stove top.

Yet another object of the present invention is to provide a new stove top protective cover which includes a flexible panel with a plurality of spaced apart sets of concentric separation lines. The panel is separable along each of the separation lines to form corresponding holes through the panel.

Still yet another object of the present invention is to provide a new stove top protective cover that may be removed from a stove top so that the protective cover may be cleaned in a dishwasher.

Even still another object of the present invention is to provide a new stove top protective cover that makes it easier to keep a stove top clean.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new stove top protective cover embodying the principles and concepts of the present invention will be described.

As best illustrated in FIGS. 1 through 4, the stove top protective cover generally comprises a flexible panel with a plurality of spaced apart sets of concentric separation lines. The panel is separable along each of the separation lines to form corresponding holes through the panel.

In closer detail, the stove top protective cover comprises a generally rectangular flexible panel 10 having top and bottom faces 11,12, and a generally rectangular outer periphery comprising a plurality of substantially straight side edges 13*a*, 13*b*, 13*c*, 13*d*, and a plurality of corners 14*a*, 14*b*, 14*c*, 14*d*. Preferably, the panel comprises a heat resistant and fire resistant material suitable for using on a stove top so that the panel does not burn or catch on fire. Even more preferably, the panel comprises an opaque material ideally colored to match the color of the stove top.

Preferably, the plurality of side edges of the sheet comprises a spaced apart first pair of side edges 13*a*, 13*c* and a spaced apart pair of second pair of side edges 13*b*, 13*d* extending between the first pair of side edges. In this preferred embodiment, the side edges of the first pair of side edges are extended substantially parallel to one another and the side edges of the second pair of side edges are extended substantially parallel to one another and substantially perpendicular to the first pair of side edges. Each of the corners of the panel is formed between corresponding adjacent pair of side edges of the panel.

The panel has a thickness defined between the top and bottom faces of the panel, a width defined between the first pair of side edges and a length defined between the second pair of side edges. In an ideal illustrative embodiment, the thickness of the panel is between about ⅛ inch and about ¼ inch, the width of the panel is bout 23 inches, and the length of the panel is about 30 inches.

Figure 1:
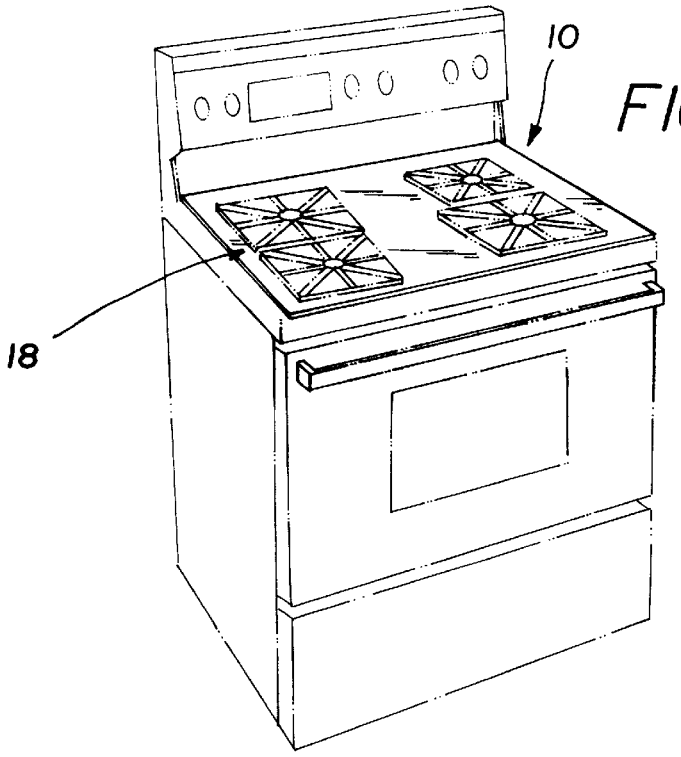
FIG. 1 is a schematic perspective view of a new stove top protective cover on a stove top according to the present invention.
Figure 2:
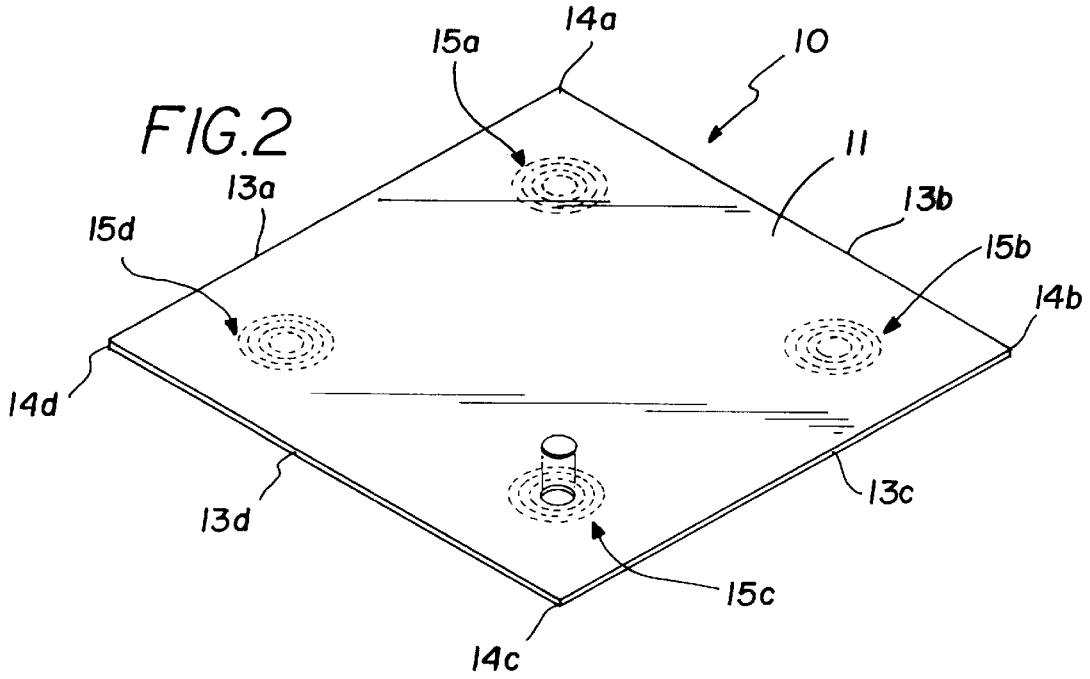
FIG. 2 is a schematic perspective view of the present invention with one of the sets of concentric separation lines having a portion separated from the panel to form a hole for extending a burner of a stove top therethrough.
Figure 3:
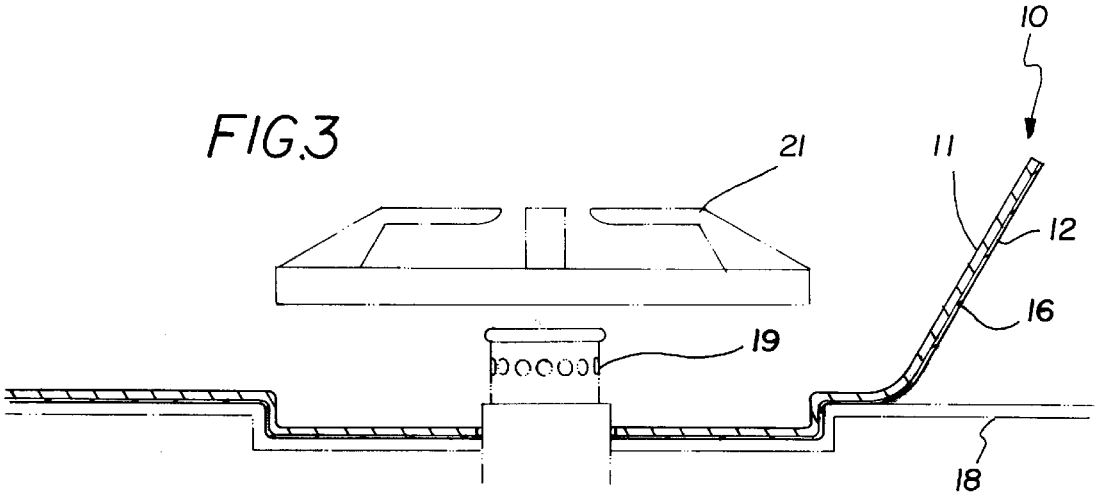
FIG. 3 is a schematic cross sectional view of the present invention in use covering a stove top.

The panel has a spaced apart plurality of sets 15*a*, 15*b*, 15*c*, 15*d* of concentric generally circular separation lines. As best illustrated in FIG. 2, each set of concentric separation lines is positioned towards an associated corner of the panel so that each corner of the panel has a set of separation lines located thereadjacent. The panel is separable along each of the separation lines to form corresponding generally circular holes through the panel extending between the top and bottom faces of the panel. As illustrated in FIG. 3, the holes through the panel each are designed for extending a burner of a stove top therethrough.

In one preferred embodiment, the panel has a plurality of apertures therethrough extending between the top and bottom faces of the panel along each of the separation lines to aid separation of the panel along each separation line. In an ideal embodiment, the panel has a plurality of perforations along each of the separation lines to aid separation of the panel along each separation line.

Each of the separation lines of each set of concentric separation lines is preferably spaced apart at generally equal intervals in the respective set of concentric separation lines. Ideally, the interval between adjacent separation lines in each set of concentric separation line is about ½ inch. Preferably, each set of concentric separation lines comprises at least generally circular three separation lines. In an ideal illustrative embodiment, an innermost of the separation of each set of concentric separation lines has a diameter of at least about 1 inch and preferably about 2 inches and an outermost of the separation of each set of concentric separation lines has a diameter of about 6 inches.

Figure 4:
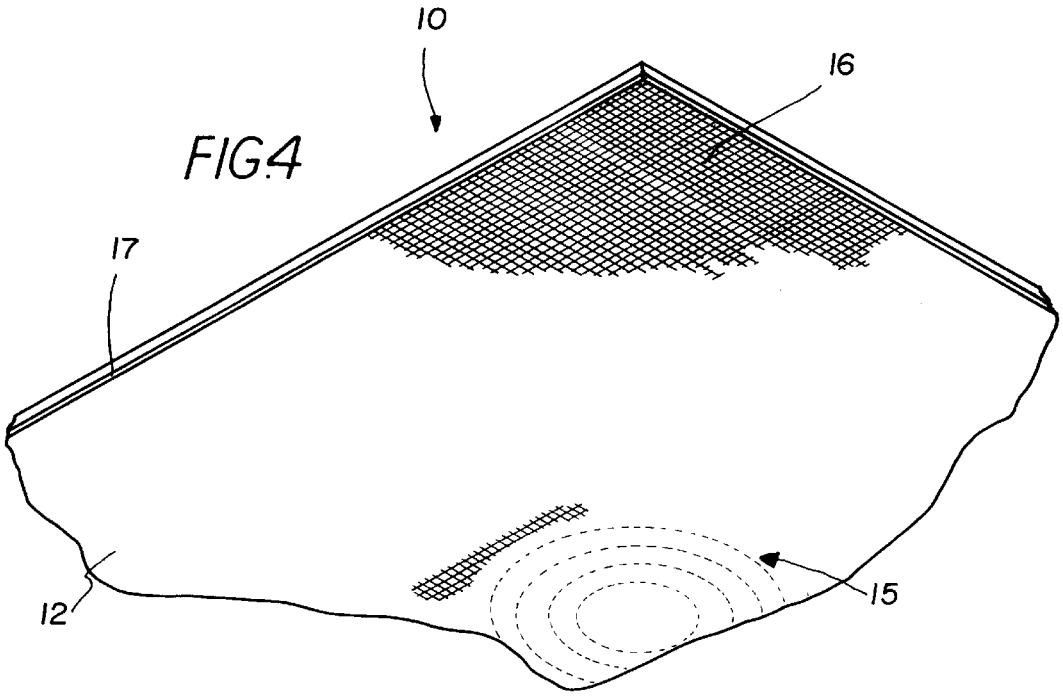
FIG. 4 is a schematic partial perspective view of the bottom face of the present invention.

With reference to FIG. 4, the back face of the panel has a substantially coextensive resiliently deformable backing 16 thereon. In use, the backing frictionally enhances contact between the back face of the panel and surface in contact with the backing such as a stove top so that the panel does not slide on the surface. Preferably, the backing has a plurality of generally straight grooves therein. In this preferred embodiment, the grooves of the backing are arranged in a generally rectangular grid-like fashion on the back face of the panel such that a first number of the grooves extend substantially parallel to one another and substantially perpendicular to a second number of the grooves. The first number of grooves are preferably extended substantially parallel to one pair of side edges of the panel while the second number of grooves are preferably extended substantially parallel to the other pair of side edges of the panel.

The back face of the panel also preferably has a magnetic edging 17 along the outer perimeter of the panel. In use, the magnetic edging is designed for magnetically coupling the back face of the panel to a magnetizable metal surface such as a metal stove top. Ideally, the edging comprises a flexible magnetic material.

In use, the stove top protective cover sheet is designed for a generally rectangular stove top 18 having has a plurality of spaced apart burners 19 upwardly extending therefrom. Typically, the stove top has a generally rectangular depression 20 around each of the burners of the stove top as illustrated in FIG. 3. The panel is positioned on the stove top so that bottom face of the panel is in contact with (i.e., rests on) the stove top and such that the panel substantially covers the stove top. Each of the sets of concentric separation lines of the panel is positioned adjacent a corresponding burner of the stove top. The panel is separated along at least one of the separation lines of each of the sets of concentric separation lines so that a plurality of holes are formed through the panel. Each of the burners of the stove top is extended through the hole formed by a separation line of the corresponding adjacent set of concentric separation lines such that the burners upwardly extend from the top face of the panel as illustrated in FIG. 3. If depressions are present on the stove top, the panel is then depressed into each of the depressions of the stove top so that the panel generally conforms to the contours of the stove top. If the stove top has grates 21 over the burners, each of the grates is then rested in a corresponding depression of the stove top on the panel, each of the grates is extended over the adjacent burner of the stove top.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stove top protective cover, comprising:

a flexible panel having top and bottom faces, and an outer periphery;

said panel having a spaced apart plurality of sets of concentric separation lines;

said panel being separable along each of said separation lines to form corresponding holes through said panel extending between said top and bottom faces of said panel; and wherein said back face of said panel has a resiliently deformable backing thereon.

2. The stove top protective cover of claim 1, wherein said outer periphery comprises a plurality of substantially straight side edges and a plurality of corners, and wherein each set of concentric separation lines is positioned towards an associated corner of said panel.

3. The stove top protective cover of claim 2, wherein said plurality of side edges of said sheet comprises a spaced apart first pair of side edges and a spaced apart pair of second pair of side edges extending between said first pair of side edges, wherein said side edges of said first pair of side edges is extended substantially parallel to one another, wherein said side edges of said second pair of side edges is extended substantially parallel to one another and substantially perpendicular to said first pair of side edges.

4. The stove top protective cover of claim 1, wherein said panel has a plurality of apertures therethrough extending between said top and bottom faces of said panel along each of said separation lines.

5. The stove top protective cover of claim 1, wherein said panel has a plurality of perforations along each of said separation lines.

6. The stove top protective cover of claim 1, wherein each of said separation lines of each set of concentric separation lines is spaced apart at generally equal intervals in the respective set of concentric separation lines.

7. The stove top protective cover of claim 6, wherein said interval between adjacent separation lines in each set of concentric separation line is about ½ inch.

8. The stove top protective cover of claim 1, wherein said backing has a plurality of generally straight grooves therein, said grooves of said backing being arranged in a grid-like fashion on said back face of said panel.

9. The stove top protective cover of claim 1, wherein said back face of said panel has a magnetic edging along said outer perimeter of said panel.

10. A stove top protective cover system, comprising:

a generally rectangular flexible panel having top and bottom faces, and a generally rectangular outer periphery comprising a plurality of substantially straight side edges and a plurality of corners;

said plurality of side edges of said sheet comprising a spaced apart first pair of side edges and a spaced apart pair of second pair of side edges extending between said first pair of side edges;

said side edges of said first pair of side edges being extended substantially parallel to one another;

said side edges of said second pair of side edges being extended substantially parallel to one another and substantially perpendicular to said first pair of side edges;

each of said corners of said panel being formed between corresponding adjacent pair of side edges of said panel;

said panel having a spaced apart plurality of sets of concentric separation lines, each set of concentric separation lines being positioned towards an associated corner of said panel;

said panel being separable along each of said separation lines to form corresponding generally circular holes through said panel extending between said top and bottom faces of said panel;

wherein said panel has a plurality of apertures therethrough extending between said top and bottom faces of said panel along each of said separation lines;

wherein said panel has a plurality of perforations along each of said separation lines;

each of said separation lines of each set of concentric separation lines being spaced apart at generally equal intervals in the respective set of concentric separation lines;

wherein said interval between adjacent separation lines in each set of concentric separation line is about ½ inch;

each set of concentric separation lines comprising at least generally circular three separation lines;

said back face of said panel having a substantially coextensive resiliently deformable backing thereon;

said backing having a plurality of generally straight grooves therein, said grooves of said backing being arranged in a generally rectangular grid-like fashion on said back face of said panel such that a first number of said grooves extend substantially parallel to one another and substantially perpendicular to a second number of said grooves;

said first number of grooves being extended substantially parallel to one pair of side edges of said panel, said second number of grooves being extended substantially parallel to the other pair of side edges of said panel;

said back face of said panel having a magnetic edging along said outer perimeter of said panel;

wherein said edging comprises a flexible magnetic material;

a generally rectangular stove top having a spaced apart plurality of burners upwardly extending therefrom;

said stove top having a generally rectangular depression around each of said burners of said stove top;

said panel being positioned on said stove top so that bottom face of said panel is in contact with said stove top and such that said panel substantially covers said stove top;

each of said sets of concentric separation lines of said panel being positioned adjacent a corresponding burner of said stove top;

said panel being separated along at least one of said separation lines of each of said sets of concentric separation lines so that a plurality of holes are formed through said panel;

each of said burners of said stove top being extended through the hole formed by a separation line of the corresponding adjacent set of concentric separation lines such that said burners upwardly extend from said top face of said panel;

said panel being depressed into each of said depressions of said stove top so that said panel generally conforms to the contours of said stove top; and a plurality of grates, each of said grates being rested in a corresponding depression of said stove top on said panel.

11. A stove top protective cover, comprising:

a flexible panel having top and bottom faces, and an outer periphery;

said panel having a spaced apart plurality of sets of concentric separation lines;

said panel being separable along each of said separation lines to form corresponding holes through said panel extending between said top and bottom faces of said panel; and wherein said back face of said panel has a magnetic edging along said outer perimeter of said panel.

12. The stove top protective cover of claim 11, wherein said outer periphery comprises a plurality of substantially straight side edges and a plurality of corners, and wherein each set of concentric separation lines is positioned towards an associated corner of said panel.

13. The stove top protective cover of claim 12, wherein said plurality of side edges of said sheet comprises a spaced apart first pair of side edges and a spaced apart pair of second pair of side edges extending between said first pair of side edges, wherein said side edges of said first pair of side edges is extended substantially parallel to one another, wherein said side edges of said second pair of side edges is extended substantially parallel to one another and substantially perpendicular to said first pair of side edges.

14. The stove top protective cover of claim 11, wherein said panel has a plurality of apertures therethrough extending between said top and bottom faces of said panel along each of said separation lines.

15. The stove top protective cover of claim 11, wherein said panel has a plurality of perforations along each of said separation lines.

16. The stove top protective cover of claim 11, wherein each of said separation lines of each set of concentric separation lines is spaced apart at generally equal intervals in the respective set of concentric separation lines.

17. The stove top protective cover of claim 16, wherein said interval between adjacent separation lines in each set of concentric separation line is about ½ inch.

* * * * *